United States Patent [19]

Williams

[11] Patent Number: 4,962,935

[45] Date of Patent: Oct. 16, 1990

[54] APPARATUS FOR PLAYING A RACQUET AND BALL GAME IN A CONFINED SPACE

[75] Inventor: John M. Williams, Ashmore, Australia

[73] Assignee: Squennis Pty. Ltd., Ashmore, Australia

[21] Appl. No.: 183,185

[22] PCT Filed: Jun. 16, 1987

[86] PCT No.: PCT/AU87/00173

§ 371 Date: Mar. 14, 1988

§ 102(e) Date: Mar. 14, 1988

[87] PCT Pub. No.: WO87/07519

PCT Pub. Date: Dec. 17, 1987

[30] Foreign Application Priority Data

Jun. 16, 1986 [AU] Australia ..... PH6427

[51] Int. Cl.[5] ..... A63B 71/02

[52] U.S. Cl. ..... 273/411; 272/3

[58] Field of Search ..... 272/2, 3; 273/411

[56] References Cited

U.S. PATENT DOCUMENTS 1,556,046 10/1925 Taylor ..... 273/411
2,823,034 2/1958 Bingham, Jr. ..... 273/411
3,201,126 8/1965 Nissen ..... 273/411 X
3,819,182 6/1974 Lersch ..... 273/342
4,284,277 8/1981 Leonard et al. ..... 273/411

FOREIGN PATENT DOCUMENTS

10112/22 11/1922 Australia .
538677 5/1984 Australia .

OTHER PUBLICATIONS

PCT Published Application WO83/01806, May, 1983, 272-2.

*Primary Examiner*—William H. Grieb
*Attorney, Agent, or Firm*—Renner, Otto, Boisselle & Sklar

[57] ABSTRACT

An apparatus for playing a racquet and ball game in a confined space comprises an enclosed playing arena having a generally rectangular playing area; upright walls surrounding said playing area; a roof extending over said playing arena and extending between opposed upper regions of the walls; and a pair of upright spaced substantially parallel barriers. The barriers extend transversely of the playing area to divide the playing area into two substantially equal player's zones. The player's zones each include a ball service boundary marked on and extending transverely of each of the player's zone. An upper edge of each of the barriers is spaced from the roof.

9 Claims, 1 Drawing Sheet

APPARATUS FOR PLAYING A RACQUET AND BALL GAME IN A CONFINED SPACE

THIS INVENTION is concerned with a novel ball game embodying an apparatus to play the game.

Most ball games such as tennis, cricket, squash and the like, whether played indoors or outdoors require a playing arena which is a permanent construction unable to be moved from one site to another.

The present invention comprises an apparatus embodying a ball game, which apparatus may be in the form of a permanent or portable playing arena According to the invention there is provided an apparatus for playing a ball game, said apparatus comprising:

an enclosed playing arena having a generally rectangular playing area;

wall means surrounding said playing area;

roof means extending over said playing arena and extending between opposed upper regions of said wall means; and, upright spaced substantially parallel barrier means extending transversely of said playing area to divide said playing area into two substantially equal player's zones, said player's zones each including a ball service boundary marked on and extending transversely of each said player's zone.

Preferably upper portions of at least one pair of opposed side walls are inclined inwardly at an angle of between 30 degrees and 60 degrees relative to an upright portion of said side walls. Most preferably the upper portions of said at least one pair of opposed side walls are inclined at 45 degrees relative to an upright portion thereof.

In a ball game playable within said apparatus, playing surfaces include all wall surfaces, a roof surface and a base surface.

The playing surfaces comprise any suitable surface, the base surface comprising any relatively flat surface such as a timber or concrete floor an earthen surface, a natural or synthetic grassed surface or the like.

The wall and/or roof playing surfaces may comprise any suitable substantially planar surface such as opaque, translucent or transparent sheet or web material such as timber, metal, glass, woven fabric or the like or any combination thereof. Most preferably the wall surfaces are comprised of open weave woven plastic mesh.

The spaced parallel transverse barriers extend to a suitable height above a base surface and the top edges thereof are spaced from said roof surface. The barriers may comprise any suitable generally planar members extending between opposed side walls of said apparatus.

The barriers each suitably comprise a mesh-like member and preferably each comprises a draped or stretched coarse weave net-like material The service boundaries suitably comprise linear markings extending transversely of said playing area between a respective barrier and adjacent parallel side wall. Most preferably said service boundary includes a ball service area having a further boundary extending therearound, said service area being located between said service boundary and an adjacent side wall.

Preferably said apparatus includes at least one securable access means in a side wall to allow entry or exit of players from the playing arena. Most preferably said access means communicates with the space between said spaced barrier means.

The apparatus may comprise any suitable frame means to support said wall means and said roof means, said frame means comprising a unitary structure, a demountable or foldable structure and/or said frame means comprising modular elements to enable erection of playing arenas of differing sizes.

The ball game is suitably played with a bat, paddle or racquet, preferably with a racquet having a mesh-like playing surface and a short handle to suit play in a relatively confined space. The ball may comprise any suitable ball but, preferably comprises a relatively soft, low density ball made from a material such as low density plastics foam.

In order that the invention may be more easily understood reference is made to the accompanying drawings which illustrate a preferred embodiment.

DETAILED DESCRIPTION OF THE DRAWINGS

Figure 1:
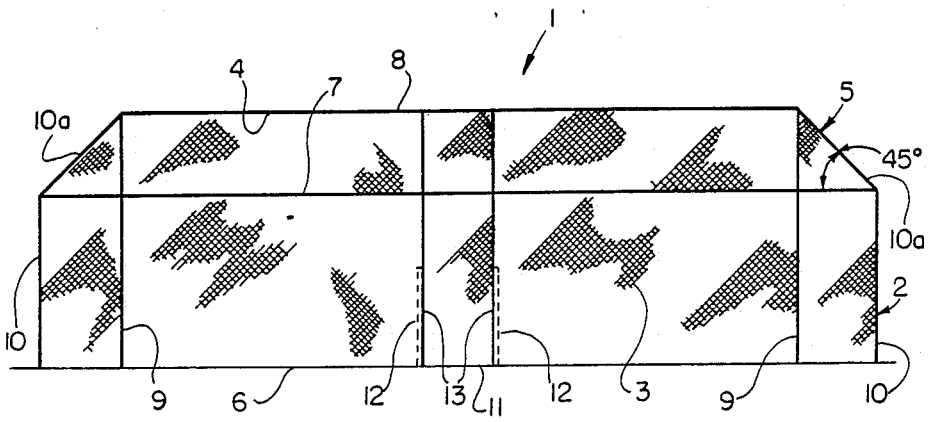
FIG. 1 illustrates a side elevation of a playing arena.

In FIG. 1 the playing arena comprises a generally rectangular playing area confined a cage-like structure 1 comprising a metal framework 2 supporting on its inner frame members mesh-like walls 3 and a roof 4 of woven plastics mesh.

The structure comprises side will frames 5 of tubular metal construction, the side walls comprising horizontal members 6, 7 and 8 and upright members 9 and 10 at each end, members 8 forming roof members and members 10 forming end wall members.

The structure 1 comprises a pair of side wall frames 5 spaced in parallel relationships by transverse frame members (not shown).

In at least one side wall there is provided an access means for players, the access means comprising a door 11 hinged to the side wall frame 5.

Extending transversely of the side wall frames 5 are games nets 12 in the form of a coarse woven mesh suspended on door frame members 13.

The end walls are formed by upright members 10 and inclined members **10*a*, suitably inclined at 45 degrees to upright members 10**.

Figure 2:
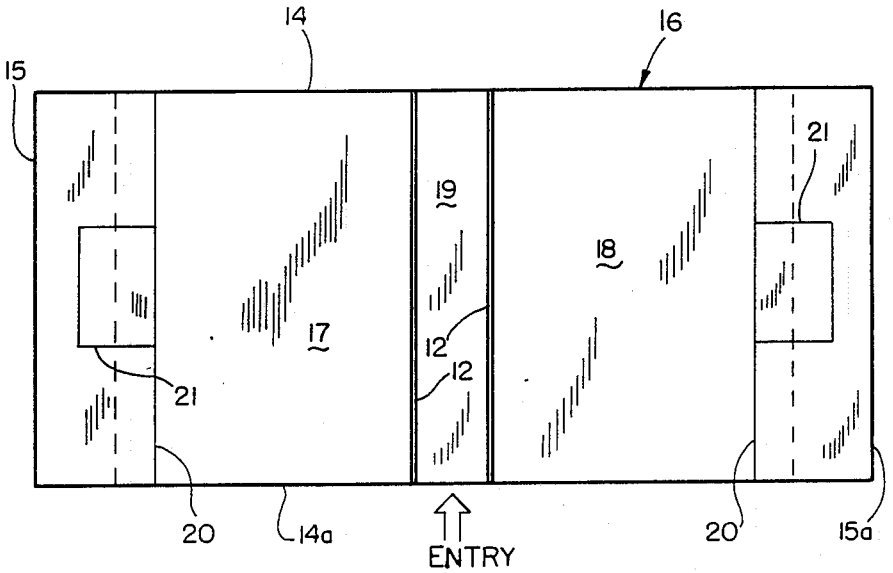
FIG. 2 illustrates a plan view the playing arena.

FIG. 2 shows a plan view of the playing arena.

The playing arena is shown as rectangular in plan having parallel opposed sides 14, **14*a* and 15, 15*a*, the sides 15, 15*a* forming the ends of the playing area 16. The playing area is divided by the spaced parallel 12 into opposed playing zones 17 and 18 separated by a lead ball zone 19** between said playing zones.

Each playing zone 17, 18 includes a service boundary marking 20 extending transversely of the playing zone and a service area defined by a further boundary marking 21.

In use, the apparatus may be used with a ball game approximating a mixture of tennis and squash. The playing surface may measure any suitable dimensions such as from say 8 m × 3 m up to 20 m × 8 m. The height of the roof may be from 3 m to 6 m. Suitably the apparatus defines a playing arena 10.2 m in length, 4 m in width and 3.2 m in height. The game may be played with two players (singles) of four players (doubles).

RULES OF THE GAME

The rules of a singles game are as follows:

1. The Score

A match shall consist of the best of 3 or 5 games, each game is to 12 points. The first player to reach 12 with a margin of 2 points wins the game. If the score reaches 11 all, the first player to gain a 2 point advantage wins the game; e.g., 13—11, 15—13 etc.

2. How to Score a Point

Points can only be scored by the server. If the server wins a rally he scores a point. If the receiver wins a rally he becomes the server.

3. The Service

The right to serve shall be decided by the spin of a racket.

4. A Good Service

For a service to be good the ball shall be thrown in the air or simply dropped and hit before it bounces or touches anything. The ball shall be struck with an underarm action from near waist level. The ball must travel in an upwards direction after it has been struck. After the server has struck the ball it must clear both nets before it touches the floor, any wall or the ceiling.

5. A Fault

If the server serves one fault he loses the service.

6. A service is a fault if:

The server serves a foot fault (see rule 7); the server makes an attempt but fails to hit the ball;

the ball is carried or thrown on the racquet.

7. A Footfault

The server must have both feet within the service box and not touching any part of the service box line. Both feet must remain in contact with the floor until the serve is struck. If the server serves a footfault he loses the service.

8. A Service Let

A service is a let if after being struck by the server and before touching the floor any wall or the ceiling it hits the top of one or both nets and lands in the opponent's side of the court. The receiver cannot return a let and the service must be replayed without alteration to the score.

9. A Good Return of Service

To make a good return the receiver must remain with both feet behind the service line until the server has struck the ball.

10. A Good Return

To make a good return the player must return the ball over both nets before it has bounced twice on the floor in his half of the court. The ball can be returned without bouncing (volleyed) at any time. The ball may rebound off any wall or the ceiling before it clears the nets.

A return is good even if after being hit and before touching the floor it hits the top of one or both nets and lands in the opponent's side of the course without first touching the floor.

11. A Return is not good if:

The striker while playing a shot reaches over or touches either net.

The racquet is not in the player's hand when the ball is struck.

The ball is hit more than once before it clears the nets.

The ball is carried or thrown with the racquet.

12. Lets

A let shall be played if:

The ball touches any article lying on the floor.

The ball breaks during play.

The service is a let (Rule 8).

On return of service the receiver is not ready and does not attempt to return the ball.

If either player is distracted by an occurrence on or off the court.

The rules of a doubles game are substantially the same as for a singles game with the following exceptions:

After a good service and a good return the four players, two per team at opposite ends of the court, return the ball alternately until one team fails to return the ball.

13. The Service

Either player in a team may serve, but the same player shall remain the server until the serve is lost.

The server's partner may stand anywhere in their half of the court, but if he is touched by the ball after it has been struck by the server and before it clears the nets, this would be a fault and they would lost the serve.

14. Receiving Service

Either player in a team may return serve, but the person receiving must remain behind the service line until the server has struck the ball.

The receiver's partner may stand anywhere in his team's half of the court, but if he is touched by the ball before it has been hit by the receiver then they shall lose a point.

15. Hitting the Ball to your Partner

You may hit the ball to your partner who then in turn must play the next shot over the net, the ball must not touch the floor after the first player hits the ball and it must be played from racquet to racquet.

This double play is also considered good on return of serve.

16. A Return will Not Be Good

If at any time the ball touches a player's body or clothing.

The ball is hit more than once by any player before it is hit by a partner or opponent.

General Rules:

Warm-up

Immediately before the match the players shall be allowed 5 minutes warm-up. In between games players will be allowed two minutes rest.

As far as practical play should be continuous with a maximum of 10 seconds between the end of one rally and the start of the next.

Duties of an Umpire

The umpire shall to the best of his or her ability see that the players abide by the rules of Squennis and play the game in a sporting and fair manner.

The umpire shall:

1. Announce the players;
2. time the warm-up;
3. call 15 seconds before start of play announce the server and call play to start the match;
4. call the score. The server's score will always be called first;
5. call game at the end of the game;
6. call 15 seconds warning between games and announce the game score before the start of the next game;
7. make decisions on faults, footfaults, lets and incorrect strokes.

If the umpire is unable to make a decision a let shall be played.

The umpire's decision shall be final.

The ball game, whenever played with the apparatus, and according to the rules described, offers a number of advantages over conventional racquet and ball games such as tennis and squash. Point scoring for example may follow either the rules of tennis or squash or comprise a variation thereof.

With the exception of the service boundaries there are no line markings which might otherwise give rise to disputed line calls. In addition when paying in a relatively confined playing area when compared with a conventional tennis court, the provision of two spaced nets prevents the playing of short or "drop" strokes and requires both service and return strokes to be played at a flatter angle thus increasing the length of rallies. Longer rallies make the game more pleasurable to players and at the same time increase the degree of sustained exercise The angled upper portion of the end walls provides a further dimension to the game and for skilled players, can add to the level of skill required to play the game successfully.

The game has been conceived with a view to providing a game capable of being enjoyed by players having a wide range of skill levels and the simplicity of the rules enable the game to be played at an exercise rate to suit the skill and fitness level of the players In the absence of line markings, points may be lost effectively only on footfaults, hitting the net or missing the ball.

The size of the apparatus is such that it may form a permanent or semi-permanent structure in a conventional backyard and for outdoor use the apparatus may include a waterproof roofing material in the event of inclement weather. The mesh-like walls enable the game to be played in an insect free environment and the structure, if required, may be employed for other outdoor recreational pursuits.

The simplicity of the structure is such that it permits easy erection and dismantling on say, a seasonal basis for outdoor use, or on a regular basis for indoor use in a meeting hall or the like. Other embodiments of the invention may include a foldable structure wherein the frame elements are pivoted for easy erection or dismantling.

Other aspects of the invention include modular frame components which may assist in erection and dismantling and/or changes to the dimensions of the playing arena.

It will be readily apparent to a skilled addressee that many modifications and variations will be possible with the apparatus and game according to the invention without departing from the spirit and scope thereof.

I claim:

1. An apparatus for playing a ball game, said apparatus comprising:

an enclosed playing arena having a generally rectangular playing area;

upright wall means surrounding said playing area and including at least one pair of opposed side walls;

roof means extending over said playing arena and extending between opposed upper regions of said wall means; and, a plurality of upright spaced substantially parallel barrier means extending transversely of said playing area to divide said playing area into two substantially equal player's zones, said player's zones each including a ball service boundary marked on and extending transversely of each said player's zone, an upper edge of each said barrier means being spaced from said roof means; and wherein upper portions of said at least one pair of opposed side walls are inclined inwardly at an angle of between 30 degrees and 60 degrees relative to upright portions of respective ones of said opposed side walls.

2. An apparatus as claimed in claim 1 wherein said barrier means comprise a coarse weave net-like material.

3. An apparatus as claimed in claim 2, wherein said upper portions of said at least one pair of opposed side walls are inclined inwardly at 45 degrees relative to upright portions of respective side walls.

4. An apparatus as claimed in claim 3 wherein said apparatus includes a frame structure mountable on a base surface, said frame structure supporting substantially planar wall and roof surfaces, each said base surface, wall and roof surface forming playing surfaces for a ball game played within said apparatus.

5. An apparatus as claimed in claim 4 wherein said frame structure is foldable and/or demountable.

6. An apparatus as claimed in claim 4 wherein said wall surfaces comprise a woven mesh material.

7. An apparatus as claimed in claim 4 wherein said roof surface comprises a weatherproof material.

8. An apparatus as claimed in claim 4 including securable access means in a side wall to allow entry to or exit from the playing arena.

9. An apparatus as claimed in claim 8 wherein said securable access means communicates with the space between said spaced barrier means.

* * * * *